US005370565A

United States Patent [19]

Yanez

[11] Patent Number: 5,370,565

[45] Date of Patent: Dec. 6, 1994

[54] RESCUE NET AND METHOD FOR RAPIDLY MOVING WATER

[76] Inventor: Peter Yanez, 4885 N. Chestnut St., Fresno, Calif. 93705

[21] Appl. No.: 194,831

[22] Filed: Feb. 14, 1994

[51] Int. Cl.[5] ..... B63C 9/00

[52] U.S. Cl. ..... 441/80

[58] Field of Search ..... 43/7, 8, 10, 14; 405/60, 63; 114/240 C, 240 E, 241; 441/80, 83, 84

[56] References Cited

U.S. PATENT DOCUMENTS

| | | | |
|---|---|---|---|
| 1,029,729 | 6/1912 | Trevisan | 441/80 |
| 1,139,113 | 5/1915 | Evans | 114/241 |
| 1,287,908 | 12/1918 | Delany | 114/240 E |
| 2,557,079 | 6/1951 | Cutri | 9/14 |
| 3,128,478 | 4/1964 | Beal | 4/172 |
| 4,652,246 | 3/1987 | Thorgeirsson et al. | 441/80 |
| 4,678,446 | 7/1987 | Dahan | 441/80 |
| 5,158,489 | 10/1992 | Araki et al. | 441/80 |

FOREIGN PATENT DOCUMENTS

| | | | |
|---|---|---|---|
| 0749729 | 7/1980 | U.S.S.R. | 441/80 |
| 1643324 | 4/1991 | U.S.S.R. | 441/80 |
| 8803495 | 5/1988 | WIPO | 441/80 |

*Primary Examiner*—Edwin L. Swinehart

*Attorney, Agent, or Firm*—Rhodes & Ascolillo

[57] ABSTRACT

A rescue device for rapidly moving water, including a net and a suspension mechanism to hold the net in a substantially vertical position in the water such that a victim being carried by the rapidly moving water may grasp or become entangled in the net. Preferably, the suspension mechanism includes weights attached to a lower portion of the net, as well as a horizontal support member disposed above the water to which the net is attached, with the support member being suspended between a support mechanism on opposite sides of the water. The horizontal support member is hollow and is disposed on a first rope extending between upper ends of vertical support posts. The first rope passes through swivels disposed in the upper ends of the vertical support posts and is attached to a ground attachment mechanism disposed at angles from the vertical support posts. Furthermore, there is a drawing mechanism to pull the substantially vertical net to a selected side of the water. It includes second and third ropes attached to ends of the horizontal support member and extends to both sides of the river to draw the support member (with the net attached thereto) along the first rope to a selected side of the river. Finally, the device includes an exposed adhesive disposed on an upstream surface of the net.

5 Claims, 2 Drawing Sheets

RESCUE NET AND METHOD FOR RAPIDLY MOVING WATER

BACKGROUND OF THE INVENTION

1. Field of the Invention

The present invention relates to lifesaving devices generally and, more particularly, but not by way of limitation, to a novel rescue net and method for use in saving persons from moving water.

2. Description of the Related Art

Trevisan U.S. Pat. No. 1,029,729, issued Jun. 18, 1912 describes a device for towing life preservers in situations in which all passengers on a sinking ship cannot be accommodated in the available lifeboat(s). The device includes an elongated, water-tight, tubular body to which life preservers are attached, as well as lines for towing the device with a lifeboat.

Cutri U.S. Pat. No. 2,557,079, issued Jun. 19, 1951 describes a water rescue device which is a net lowered into water from a davit on a ship in order retrieve persons from the water.

Beal U.S. Pat. No. 3,128,478, issued Apr. 14, 1964 describes a buoyant net and safety cover for a swimming pool which comprises a mesh net placed on the surface of the water and fixed to the edges of the pool.

Dahan U.S. Pat. No. 4,678,446, issued Jul. 7, 1987 describes a device for rescuing persons from water which includes a crane on a ship. A float with a rescue net attached thereto is lowered from the end of a positionable boom on the crane.

U.S. Pat. No. 5,158,489, issued Oct. 27, 1992, describes a water rescue device which includes a net having a plurality of buoys to provide buoyancy to the net. The net is thrown to a person in the water who either grasps the net or is entangled by it. The net is then raised to the deck of a ship by means of a line attached to the net.

SUMMARY OF THE INVENTION

Annually, in the United States, over 5,000 persons die from drowning. Many drown as a result of being caught up by the raging waters of a flash flood or a rapidly flowing river. They cannot resist the current and are completely helpless as they are being swept along by it. Because of the nearly neutral buoyancy of a human body in water, the turbulence of the water causes the victim to be easily drawn beneath the surface of the water. The conditions may be so severe as to preclude others from entering into the water to rescue the victim, and the possibilities of having the victim grasp a tossed rescue line in such circumstances are virtually nil. There is no known satisfactory method of response to such an emergency.

None of the above mentioned devices is adaptable for rescuing a person from rapidly moving water.

Accordingly, it is a principal object of the present invention to provide a device for rescuing persons from rapidly moving water.

It is an additional object of the invention to provide such a device that is readily deployed and used.

It is a further object of the invention to provide such a device that is economically constructed.

Other objects of the present invention, as well as particular features, elements, and advantages thereof, will be elucidated in, or be apparent from, the following description and the accompanying drawing figures.

The present invention achieves the above objects, among others, by providing, in a preferred embodiment, a rescue device for rapidly moving water, including a net and a suspension mechanism to hold the net in a substantially vertical position in the water such that a victim being carried by the rapidly moving water may grasp or become entangled in the net.

Preferably, the suspension mechanism includes weights attached to a lower portion of the net, as well as a horizontal support member disposed above the water to which the net is attached, with the support member being suspended between a support mechanism on opposite sides of the water. The horizontal support member is hollow and is disposed on a first rope extending between upper ends of vertical support posts. The first rope passes through swivels disposed in the upper ends of the vertical support posts and is attached to a ground attachment mechanism disposed at angles from the vertical support posts. Furthermore, there is a drawing mechanism to pull the substantially vertical net to a selected side of the water. It includes second and third ropes attached to ends of the horizontal support member and extends to both sides of the river to draw the support member (with the net attached thereto) along the first rope to a selected side of the river. Finally, the device includes an exposed adhesive disposed on an upstream surface of the net.

In another aspect, the invention generally features a method of rescuing a victim from rapidly moving water. This method includes suspending a net in a substantially vertical position in the water such that a victim being carried by the rapidly moving water may grasp or become entangled in the net, and drawing the substantially vertical net horizontally to a selected side of the river to retrieve the victim therefrom.

BRIEF DESCRIPTION OF THE DRAWINGS

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENT

Figure 1:
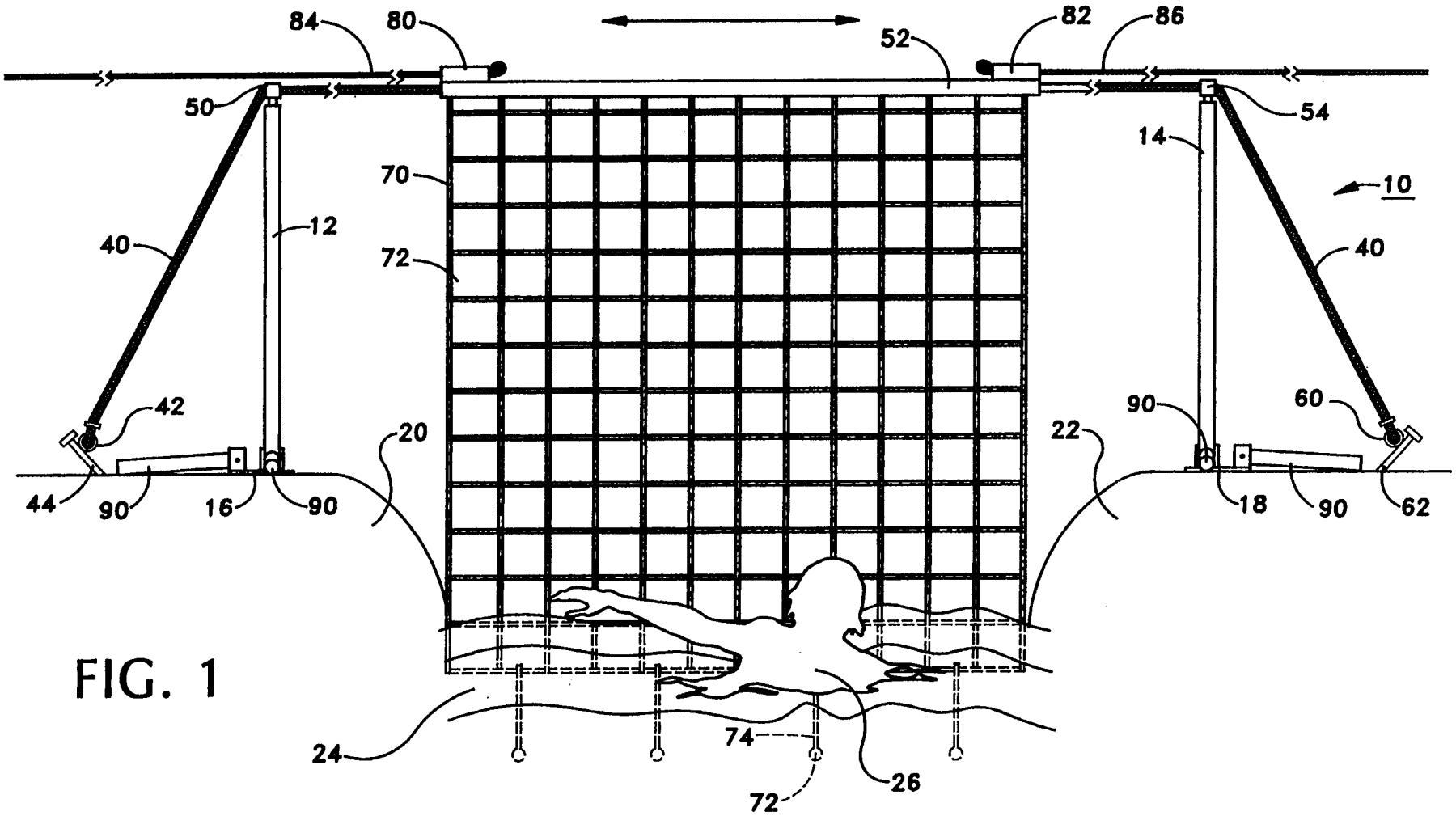
FIG. 1 is side elevational view of a rescue device according to the present invention.

Reference should now be made to the drawing figures in which FIG. 1 illustrates a rescue device according to the present invention, generally indicated by the reference numeral 10. The rescue device 10 includes two support posts 12 and 14 extending upwardly from base plates 16 and 18, respectively, to which the support posts 12 and 14 are attached. Base plates 16 and 18 are disposed on opposite banks 20 and 22, respectively, of a river 24 in which a victim 26 is being carried by what may be assumed to be a rapidly moving current.

One end of a rope 40 is attached to an eye 42 which, in turn, is fixedly attached to a first stake 44 driven into bank 20. Rope 40 is inclined upwardly from eye 42, then passes through a swivel 50 disposed in the distal end of support 12, then through a horizontal tube 52 disposed above river 24, through another swivel 54 disposed in the distal end of support 14, and finally inclined downwardly, pulled taut, and then secured to another eye 60, fixedly attached to a second stake 62 driven into bank 22.

Attached to and hanging from horizontal tube 52 is a vertical net 70 having a plurality of weights, as at 72, attached to the lower edge of the net by means of ropes, as at 74. The weights 72 are selected to be sufficiently heavy in order to maintain net 70 substantially vertical, with the lower edge of the net 70 disposed a selected distance below the surface of river 24 and, preferably, to maintain the lower edge of the net close to the bottom of the river. With net 70 so disposed, it can be seen that victim 26 will encounter the net so that the victim may either grasp the net or become entangled in it.

Attached to, and resting atop the ends of horizontal tube 52 are short tube portions 80 and 82 which serve as anchors for the proximal ends of ropes 84 and 86, with the distal ends of which extend over banks 20 and 22, respectively. This allows horizontal tube 52 (with net 70 attached thereto) to be pulled along rope 40 to one bank or the other to retrieve victim 26 from the net. This is illustrated on FIG. 2, where tube 52 has been drawn to the right in the figure by means of pulling rope 86 while releasing rope 84.

Figures 2, 3:
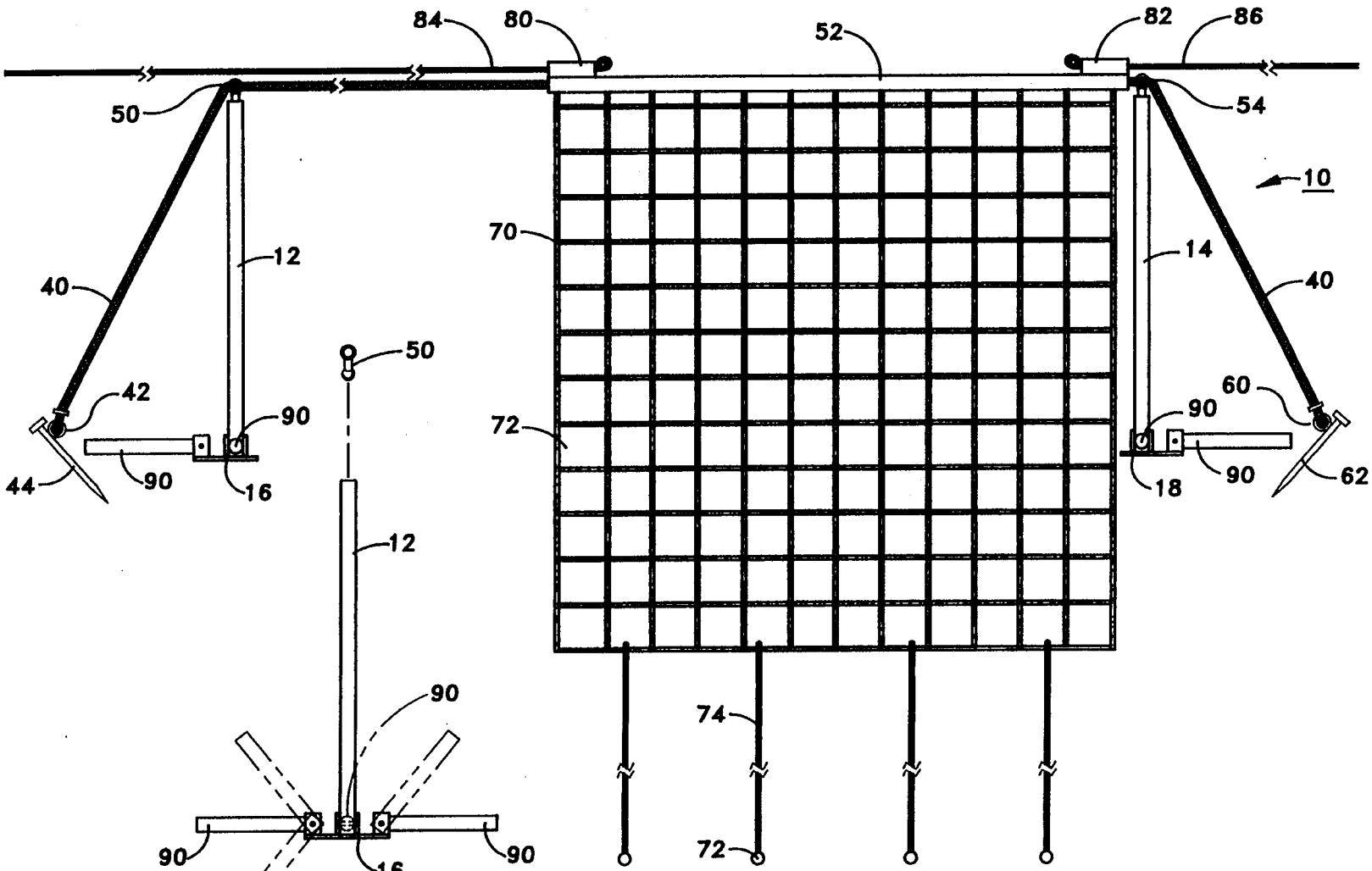
FIG. 2 is a side elevational view of the rescue device in position for retrieving a victim therefrom.
FIG. 3 is an end elevational view of one support for the rescue device.

Referring now to FIG. 3, each of the base plates 16 and 18 has attached thereto three support arms 90. The distal ends of the support arms 90 engage the surfaces of banks 20 and 22 to assist in the support of the device 10. Each of the support arms 90 can be locked in a selected rotated position with respect to the base plates 16 and 18 to permit support of the device 10 on uneven ground.

The mesh openings 72 in net 70 are preferably about eight inches square, and the net is fabricated from nylon, having a sticky tape surface applied to the upstream side of the net 70 to help prevent victim 26 from sliding off. Support posts 12 and 14 and support arms 90 are preferably formed from rigid, heavy plastic tubing, as are horizontal tube 52 and short tube portions 80 and 82. The ropes 40 may be metallic wire or DACRON® braid; however, ropes 84 and 86 are preferably DACRON® braid. All elements of the device 10 are economically purchased or constructed and are suitably sized for the application.

The elements of the device 10 are relatively light, permitting its rapid deployment. These elements can also be conveniently stored in rescue vehicles or at selected sites along rivers.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A rescue device for rapidly moving water, comprising:

(a) a net;

(b) suspension means to hold said net in a substantially vertical position in said water such that a victim being carried by said rapidly moving water in a river may grasp or become entangled in said net;

said suspension means further comprises a horizontal support member disposed above said water to which said net is attached, said support member being suspended between support means on opposite banks of said river;

said horizontal support member is hollow and disposed on a first rope extending between upper ends of vertical support posts;

a drawing means to pull said substantially vertical net to a selected bank of said river;

said drawing means further comprises second and third ropes attached to ends of said horizontal support member and extending to opposing banks of said river to draw said support member with said net attached thereto along said first rope to a selected bank of said river.

2. A rescue device, as defined in claim 1, wherein said suspension means further comprises weights attached to a lower portion of said net.

3. A rescue device, as defined in claim 1, wherein said first rope passes through swivels disposed in said upper ends of said vertical support posts and is attached to ground attachment means disposed at angles from said vertical support posts.

4. A rescue device, as defined in claim 1, further comprising an exposed adhesive disposed on an upstream surface of said net.

5. A method of rescuing a victim from rapidly moving water of a river, comprising:

(a) suspending a net in a substantially vertical position in said water such that a victim being carried by said rapidly moving water may grasp or become entangled in said net;

(b) attaching a weight to the net;

(c) attaching the net to a hollow horizontal support member;

(d) disposing the hollow horizontal support member on a first rope;

(e) attaching a second rope to an end of the hollow horizontal support member and attaching a third rope to another end of the hollow horizontal support member;

(f) disposing an adhesive on an upstream side of the net;

(g) releasably adhering the victim to the adhesive on the upstream side of the net; and (h) drawing said substantially vertical net horizontally to a selected bank of said river to retrieve said victim therefrom.

* * * * *